US005893376A

United States Patent [19]

Glassberg

[11] Patent Number: 5,893,376

[45] Date of Patent: Apr. 13, 1999

[54] MULTI LAYERED DECORATIVE FASHION ACCESSORY AND METHOD OF MANUFACTURE

[76] Inventor: Dennis Glassberg, Box 1089, Commack, N.Y. 11725

[21] Appl. No.: 08/935,799

[22] Filed: Sep. 23, 1997

Related U.S. Application Data

[63] Continuation of application No. 08/607,082, Feb. 26, 1996, abandoned.

[51] Int. Cl.[6] ..... A45D 8/34

[52] U.S. Cl. ..... 132/273

[58] Field of Search ..... 132/273, 275; 2/300, 303, 306, 308, 311, 240, 321, 428; D28/10, 39, 41; 428/919, 295, 294, 293, 356, 230, 231, 232

[56] References Cited

U.S. PATENT DOCUMENTS

| | | | |
|---|---|---|---|
| D. 313,485 | 1/1991 | Malouf | D28/41 |
| D. 336,544 | 6/1993 | Maturaporn | D28/41 |
| D. 348,331 | 6/1994 | Marrese | D28/41 |
| 1,636,107 | 7/1927 | Namiot | 2/300 |
| 5,044,385 | 9/1991 | Rhodes | 132/275 |
| 5,156,171 | 10/1992 | Goodman | D28/41 |
| 5,379,782 | 1/1995 | Tabb | 132/275 |

*Primary Examiner*—Todd E. Manahan
*Assistant Examiner*—Eduardo C. Robert
*Attorney, Agent, or Firm*—Gerard F. Dunne

[57] ABSTRACT

A decorative fashion accessory is formed of an elastic band having a plurality of layers of fabric material held in a gathered condition around the band. The layers are held to the band in such a manner that each rim portion may bunch individually as the elastic band contracts to provide a decorative fashion accessory which can resemble attractively a flower or similar ornament.

7 Claims, 7 Drawing Sheets

MULTI LAYERED DECORATIVE FASHION ACCESSORY AND METHOD OF MANUFACTURE

This application is a continuation of application Ser. No.: 08/607,082 filed Feb. 26, 1996 and now abandoned.

FIELD OF THE INVENTION

The present invention relates to a decorative fashion accessory having multiple bunched layers of fabric to provide a rather attractive fashion accessory which can be used, for example, as a ponytail holder.

BACKGROUND OF THE INVENTION

Fashion accessories, such as ponytail holders, formed of elastic bands decorated with fabric have taken many decorative forms. An early style of such ponytail holders is illustrated in U.S. Design Pat. No. Des. 292,030. This hair band is typically formed of an annulus of fabric material bunched around a free-flowing elastic band. Similar ponytail holders have been developed, such as that illustrated in U.S. Design Pat. No. 313,485, which included a ponytail holder similar to that noted above with fabric material held circularly to such a ponytail holder so as to provide a free-flowing cascade of decorative fabric. The ponytail holders illustrated in U.S. Design Pat. No. Des. 315,036 include fabric material arranged circumferentially around an elastic cord which has the layers of fabric secured at their rim portions so as to simulate the petals of a flower. Other hair accessories, such as shown in U.S. Design Pat. No. Des. 315,226, have fabric material again secured at circumferential rim portions and gathered around an elastic center.

A more recent development is U.S. Design Pat. No. Des. 336,544 illustrating a hair band which is formed of layers of fabric material gathered loosely around an elastic member; and similarly U.S. Pat. No. 5,044,385 illustrates an elastic ponytail holder form from a rectangular piece of fabric which is stitched into a flattened tube and stretched under tension and slit transversely to simulate a flower arrangement.

Elastic ponytail holders decorated with fabric have, therefore, been disclosed and used by the art. Known ponytail holders have varying means of construction and arrangement of the fabric material; and the industry continually has a need for fabric fashion accessories which can be used as ponytail holders, decorative wrist bands and the like and yet provide a new and distinctive ornamentation that can be manufactured by techniques enabling mass production.

By my invention, I have provided a decorative fashion accessory that can be fabricated by mass production techniques and yet provide a distinctive and highly decorative fashion accessory which can be used as a ponytail holder, decorative wrist band and the like.

SUMMARY OF THE INVENTION

According to the present invention, a decorative fashion accessory is provided with an elastic band having a plurality of layers of fabric material held gathered around the band. These layers of fabric material are each held by the band and extend to respective rim portions which are able to bunch individually as the elastic band contracts into its rest condition. In this way, multiple layers of bunched fabric material are provided around the elastic band, and the rim portions of these layers have been bunched individually so as to provide an attractive arrangement of fabric which can simulate a rose-like flower as illustrated in my co-pending design application incorporated by this reference and filed on Feb. 26, 1996 as Ser. No. 29/051,292.

Preferably, the layers of fabric material are gathered individually and stitched centrally along their axis along the elastic band. The elastic band is then formed into a circle and has its ends stitched together. In one embodiment of the present invention, at least one of the fabric layers will be gathered appreciably more than other layers prior to being stitched to the elastic band; while in another embodiment the layers will be gathered uniformally prior to being stitched to the elastic band.

Layers of fabric can also be formed as a continuous strip of fabric material which can be arranged around an elastic band in various layers. One method would be to gather the length of fabric and stitched it along an elastic element, and then fold the elastic and fabric about its transverse axis and bring the ends together to provide a circular array of various layers of fabric around an elastic band.

Alternatively, a single layer of fabric can be gathered and stitched along the length of an elastic element, so that the elastic can be coiled upon itself and formed into a circle with its ends stitched together to provide multiple layers arranged around a circular band.

In another method of forming the multiple layers by use of a continuous strip of fabric material, the strip of fabric material can be gathered along an elastic element which is then twisted to form a spiral; and then feeding through a sewing machine another gathered length of fabric material which would be stitched spirally around the axis of the previously twisted strip. Again, this arrangement can then be formed into a circle and the ends stitched together to provide an array of fabric of multiple layers arranged around a continuous elastic band.

These and other objects, advantages and features of the present invention will become more apparent from the detailed descriptions made below in conjunction with the accompanying drawings.

DETAILED DESCRIPTION OF PREFERRED EMBODIMENTS

Figure 1:
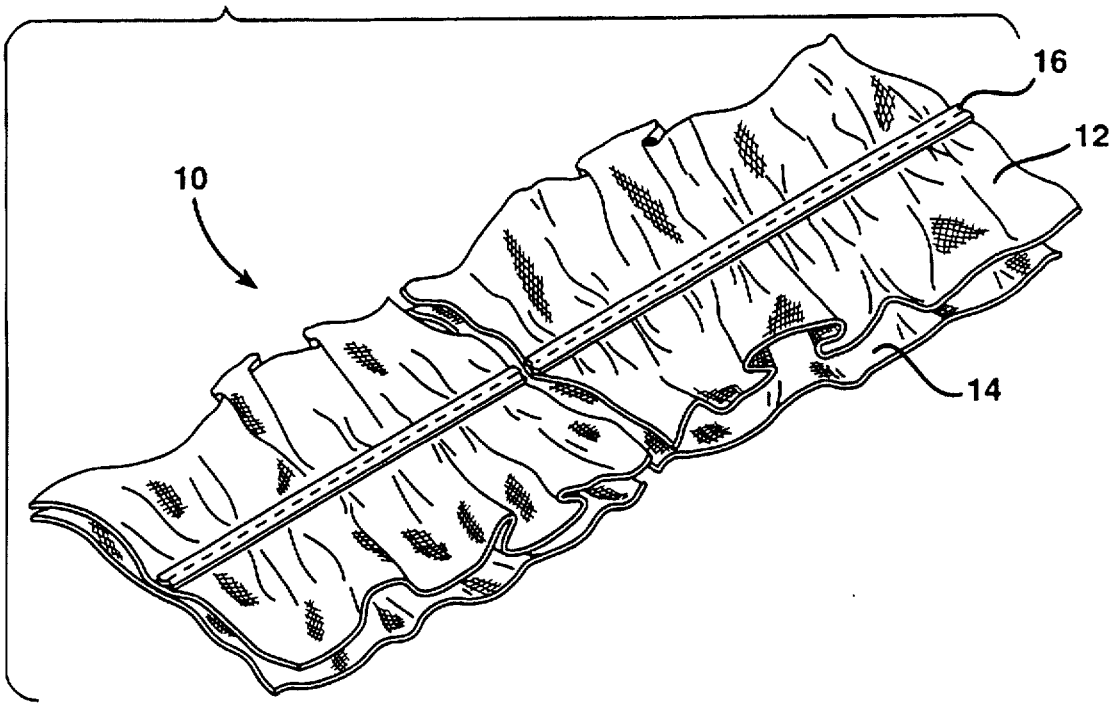
FIG. 1 illustrates an embodiment of the present invention partially in section prior to the elastic being formed into a circular loop.

As illustrated in FIG. 1, a decorative fashion accessory 10 of the present invention includes layers 12 and 14 of decorative fabric material which are gathered individually and aligned coextensively. An elastic length 16 is arranged longitudinally along the gathered layers 12 and 14 and stitched thereto approximately along the longitudinal axis. As would be understood, the elastic length 16 may be offset from the longitudinal axis to vary the decorative effect.

Figure 1A:
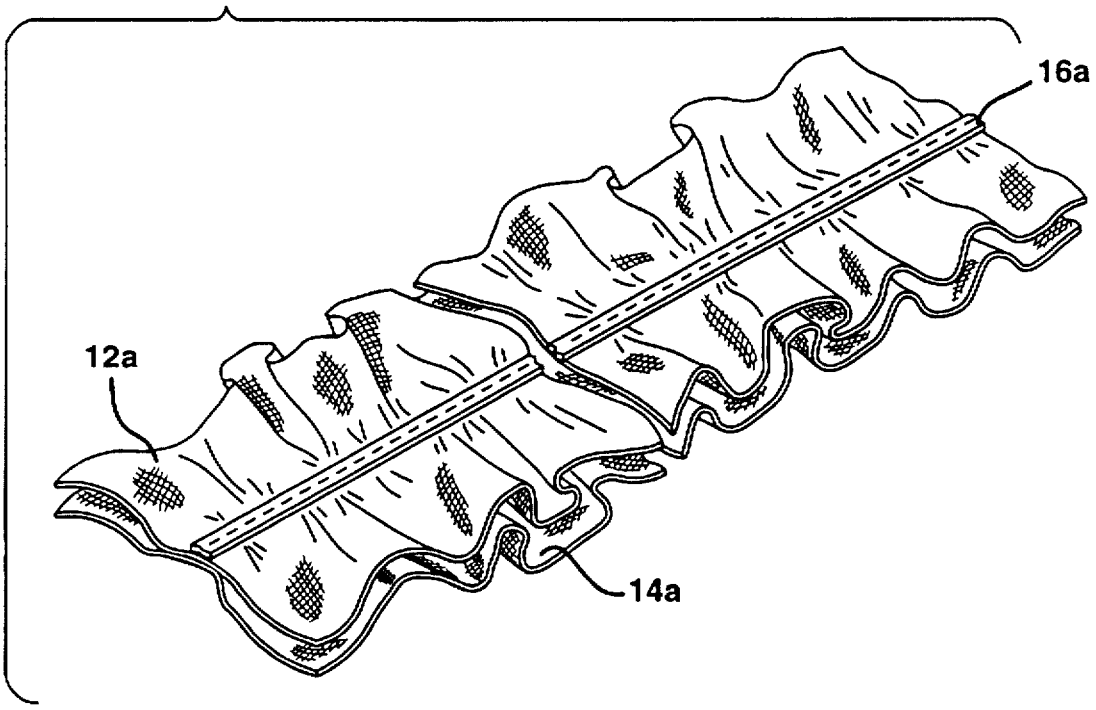
FIG. 1A is an alternate embodiment of FIG. 1.

In the embodiment of FIG. 1, the layers 12 and 14 are gathered differently; and the upper layer 12 as illustrated in FIG. 1 is gathered appreciably more than the lower layer 14; and, in fact, the more gathered layer 12 may include a length of fabric more than fifty percent longer than the length of fabric used to make the lower layer 14. Alternatively, as illustrated in FIG. 1A, the two layers 12*a* and 14*a* are uniformally gathered approximately the same amount prior to the elastic element 16*a* being stitched centrally along the approximate longitudinal axis.

Figure 2:
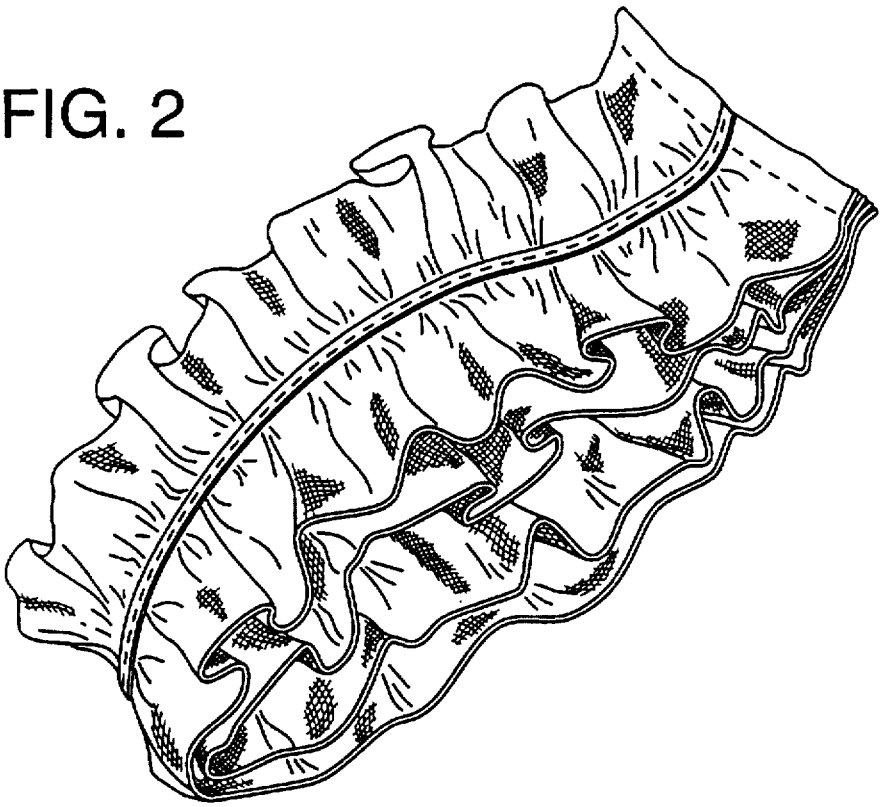
FIG. 2 illustrates the embodiment of FIG. 1 formed into a circular loop.

After the combination of the gathered layers of fabric and elastic length are secured together by stitching or other appropriate means, the assemblage is formed into a circle as illustrated in FIG. 2 and the ends are secured together, for example, by stitching. In the embodiment illustrated in FIG. 2, the ends are stitched together as illustrated and then the assemblage may be turned inside out to provide a circular fashion accessory which may, for example, be a ponytail holder, decorative wrist band or the like. Alternatively, the two ends of the assemblage of FIGS. 1 or 1A could be overlapped and then stitched together instead of the manner shown in FIG. 2.

The decorative fashion accessory of the present invention could be formed of fabrics having matching colors or even coordinated or contrasting colors. It is also should be understood that one or more of the fabrics that are used to create the decorative fashion accessory of the present invention could have a printed pattern thereon. In fact, applicant has created attractive fashion accessories by providing one layer of fabric material of a solid color and the other layer of a complementary print so that the assemblage would provide a very attractive mixture of layers of fabric material, as illustrated in my co-pending design application noted above.

Preferably, the elastic length 16 is stretched prior to being stitched to the gathered layers 12 and 14. In this way, the elastic layer will contract after being attached to the fabric layers to further gather the fabric layers 12 and 14 so that tightly bunched layers of fabric will be created. Thereafter, as the assemblage is formed into a circle and the ends stitched together, tightly bunched layers of fabric will have been formed into a circular fashion, and the rim or edge portions of each layer will have been bunched individually so as to provide a very attractive decorative effect as the elastic band contracts to its rest condition after being stretched to be applied to the hair or the like.

Figure 4:
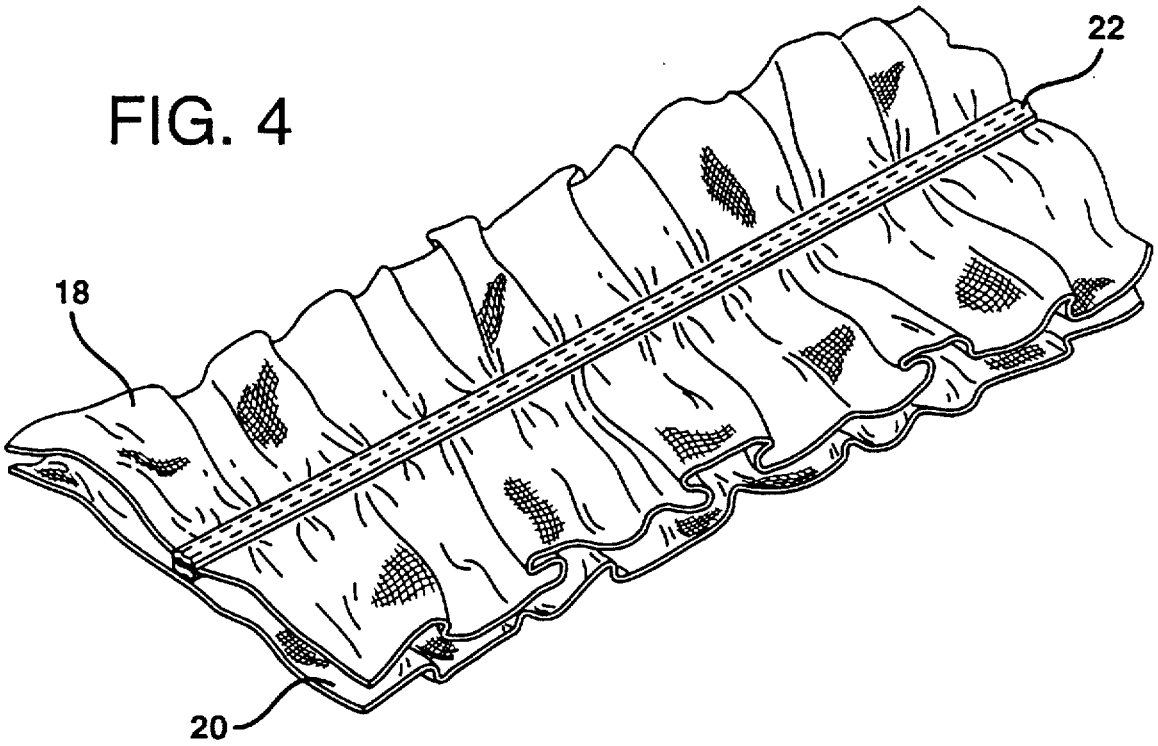
FIG. 4 illustrates the assemblage of FIG. 3.
Figure 3:
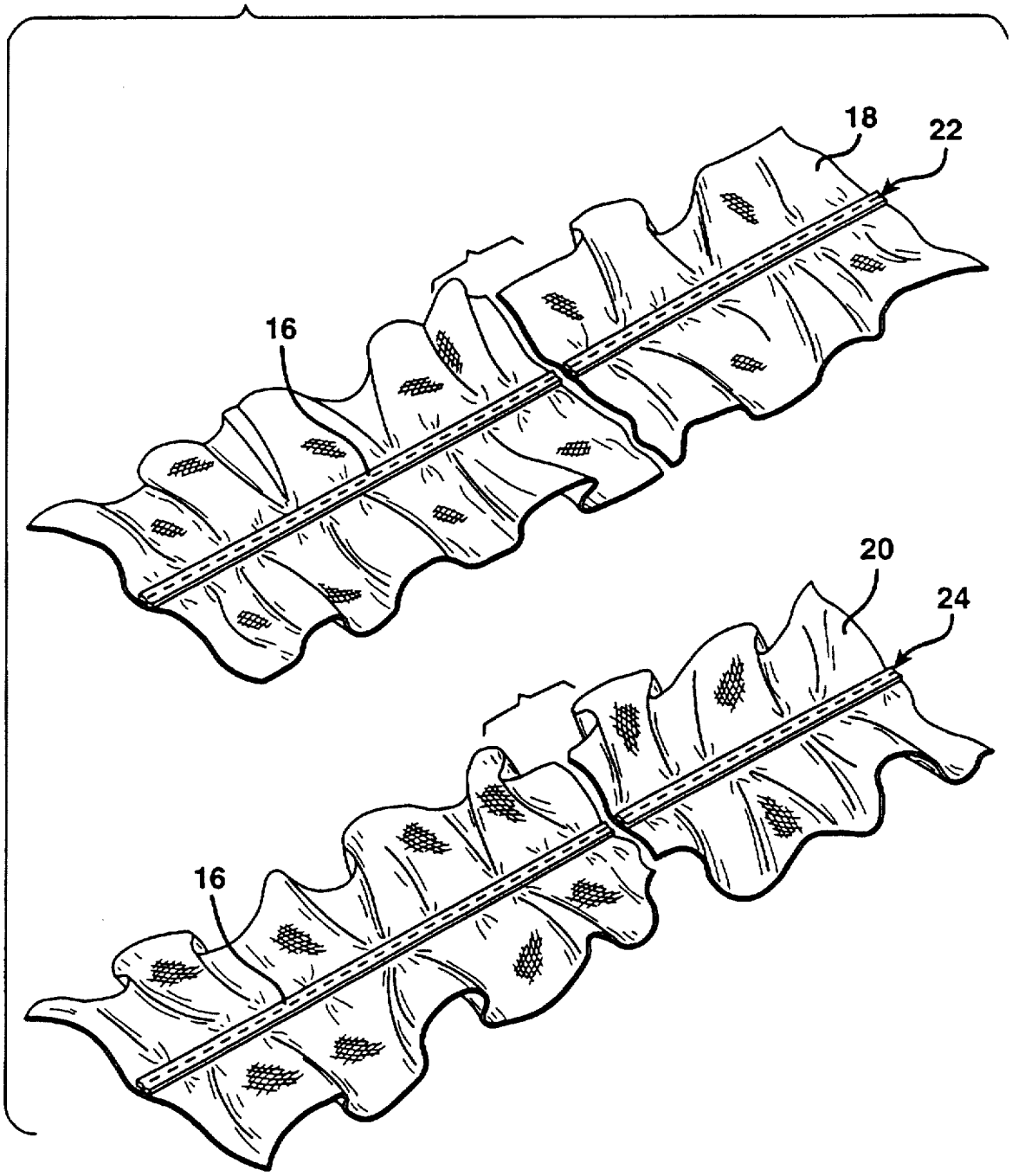
FIG. 3 is an exploded view partially in section of another embodiment of the present invention.

FIG. 3 illustrates an alternate embodiment of the present invention, and includes lengths of fabric 18 and 20 which are gathered and each have a respective length 22 and 24 of elastic material which is stretched over the gathered layer of fabric and then stitched centrally along the longitudinal axis thereto. This enables greater control over the gathering of each fabric layer; and thereafter the total assemblage illustrated in FIG. 3 can be combined and stitched together to form the assembly illustrated in FIG. 4. The assembly in FIG. 4 can then be formed into a circle with the ends secured together as would be understood under the descriptions made above in connection with the embodiments of FIGS. 1 and 1A.

Figure 5:
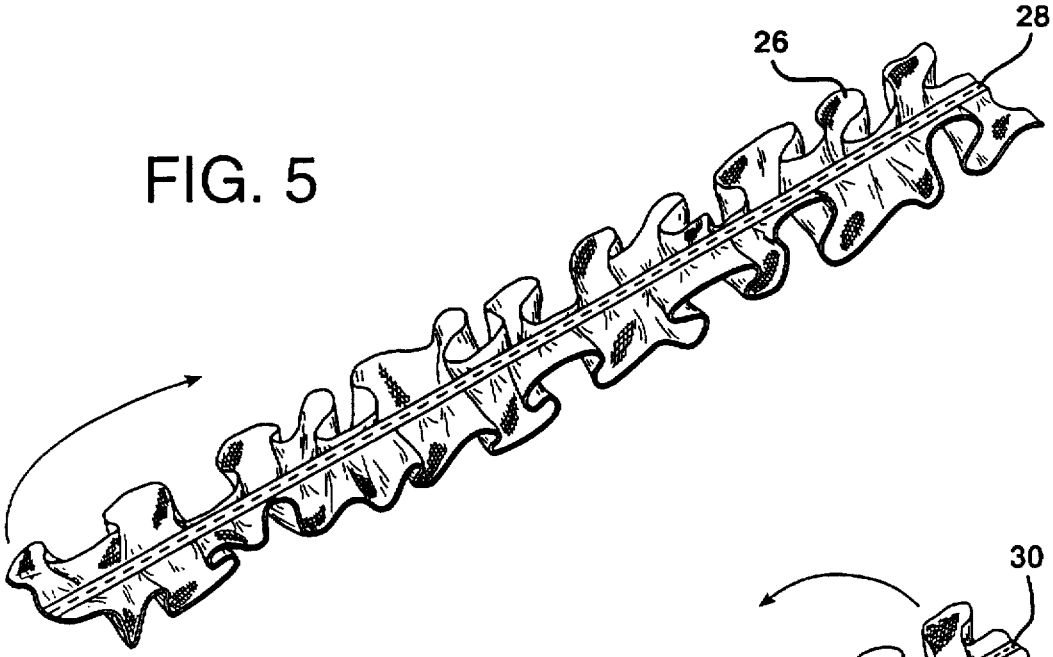
FIG. 5 illustrates an embodiment of the present invention utilizing a single length of gathered fabric material.

In the embodiment illustrated in FIG. 5, a continuous strip 26 of a fabric material is gathered appreciably along its length and an elastic length 28 is stitched centrally approximately along the longitudinally axis of the continuous strip 26 of fabric material. Unlike the prior embodiments, however, it is preferred that the elastic element 28 is not stretched to any great extent prior to the stitching to the gathered strip of fabric material. Consequently, the strip of fabric material would be gathered appreciably more than the gathered length for the earlier embodiments inasmuch as there that would not be a further bunching of the gathered material as the elastic length retracts.

Figure 6:
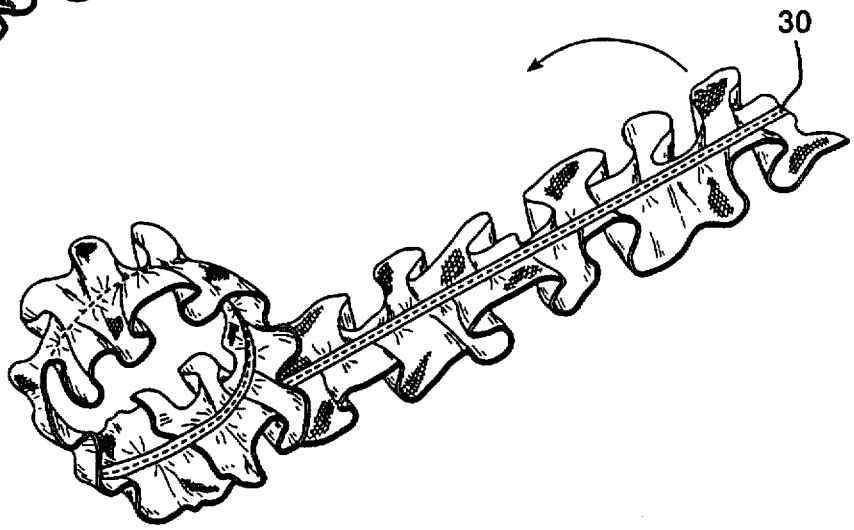
FIGS. 6 through 8 illustrate the steps in assembling the embodiment of FIG. 5.
Figure 7:
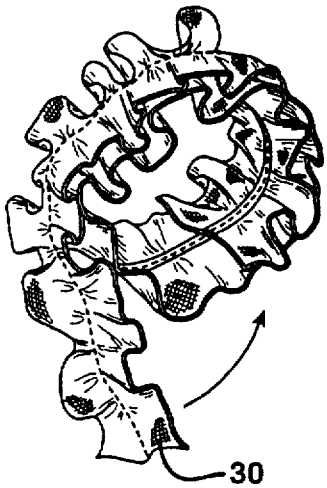
Figure 8:
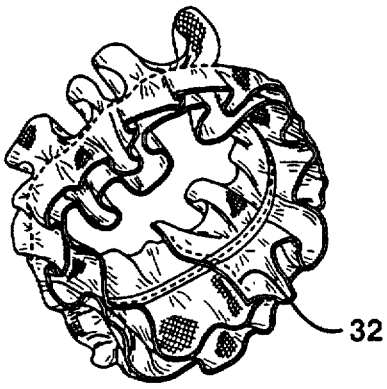

To form the decorative fashion accessory, the elastic length 28 held to the gathered strip 26 of fabric material is stretched and then coiled as illustrated in FIGS. 6 and 7 until the free end 30 is brought to lie along the coiled strip and then stitched to the strip as illustrated at 32 in FIG. 8.

As the now coiled elastic 28 contracts, the fabric layers are bunched individually to provide multiple layers providing an attractive decorative effect for a fashion accessory.

Figure 9:
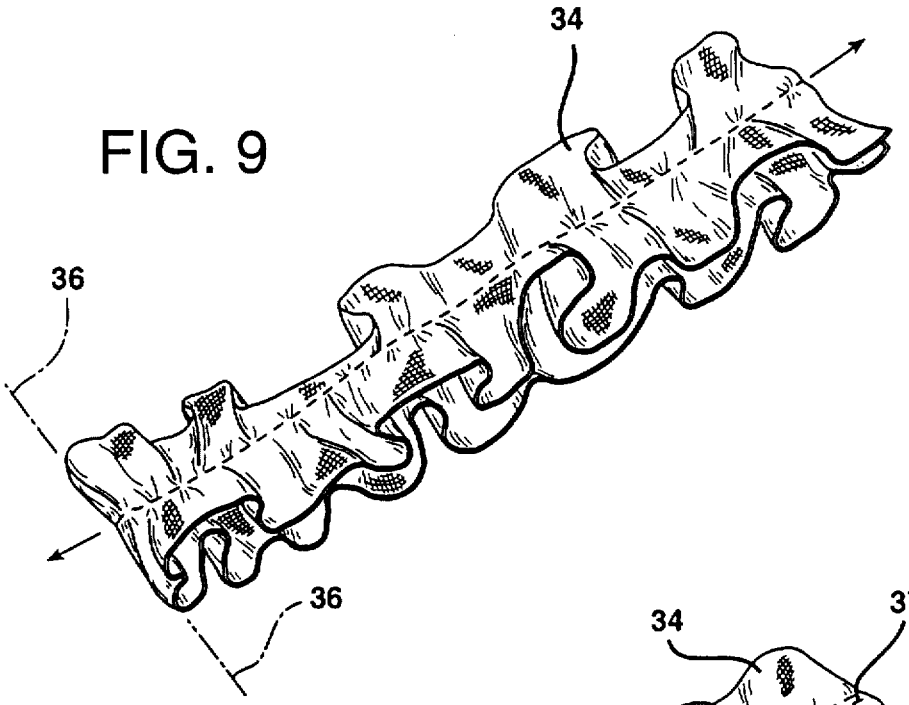
FIG. 9 illustrates another embodiment utilizing a single length of fabric material.
Figure 10:
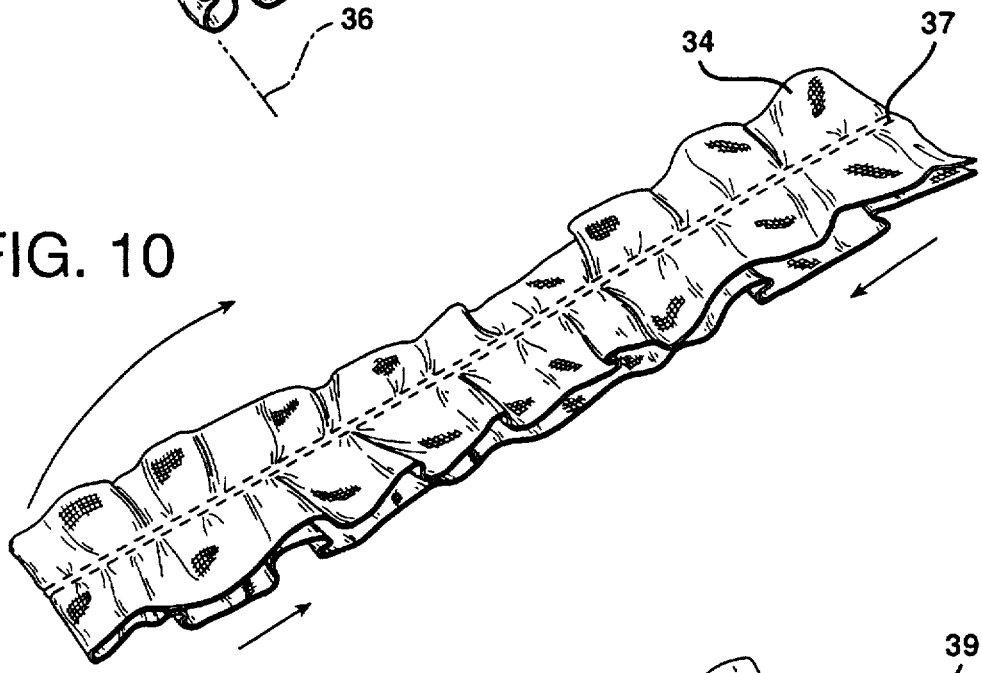
FIGS. 10 and 11 illustrate the steps of assembly of the embodiment of FIG. 9.
Figure 11:
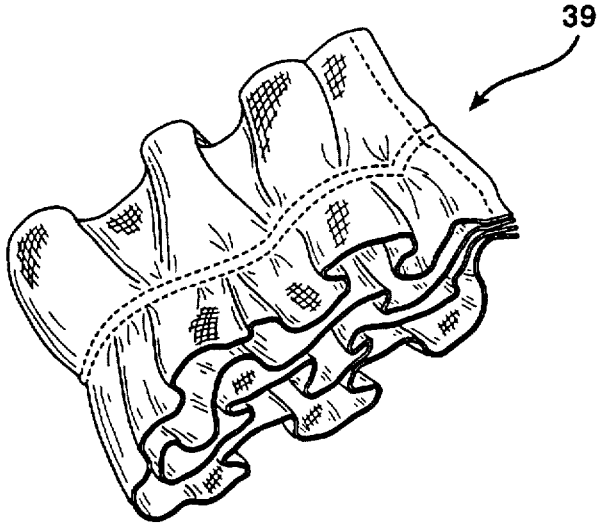

FIGS. 9 through 11 illustrate another method of manufacturing a decorative fashion accessory formed from a continuous strip of fabric material. As illustrated in FIG. 9, a continuous strip of fabric material 34 is gathered and then folded in half along a transverse axis 36. As illustrated in FIG. 10, an elastic length 37 is stretched and then stitched along the longitudinal axis of the folded strip 34 of gathered fabric material, and then the elastic length 37 is allowed to contract and then is formed circular with the ends stitched together to form the construction 39 illustrated in FIG. 11.

Alternatively, a decorative fashion accessory according to this embodiment can be fabricated from the construction of FIG. 5 where the continuous strip of fabric material is gathered and then stitched to the elastic length extending longitudinally along the central axis; and the continuous strip is folded along its transverse axis and then formed into a circle stitched together to resemble the resultant end product of FIG. 11. The construction as just described, however, will require a longer elastic length and thus would be more expensive, but may be simply manufactured by automated techniques.

Figure 12:
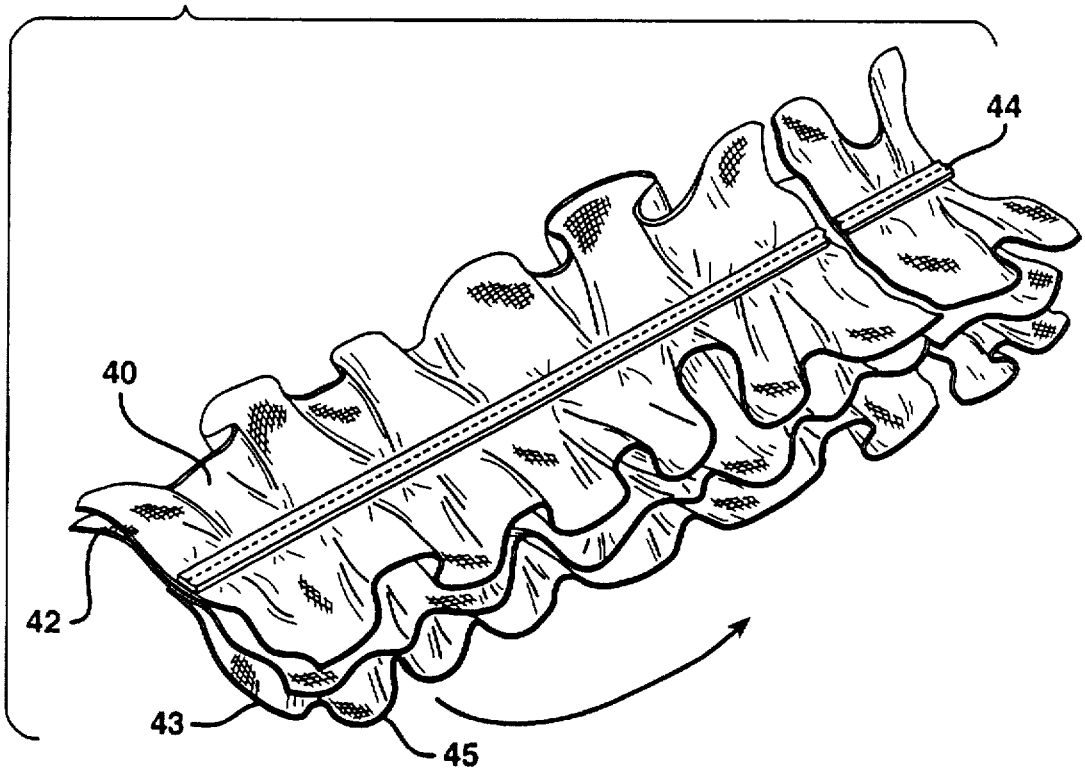
FIG. 12 illustrates another embodiment of the present invention partially in section.
Figure 13:
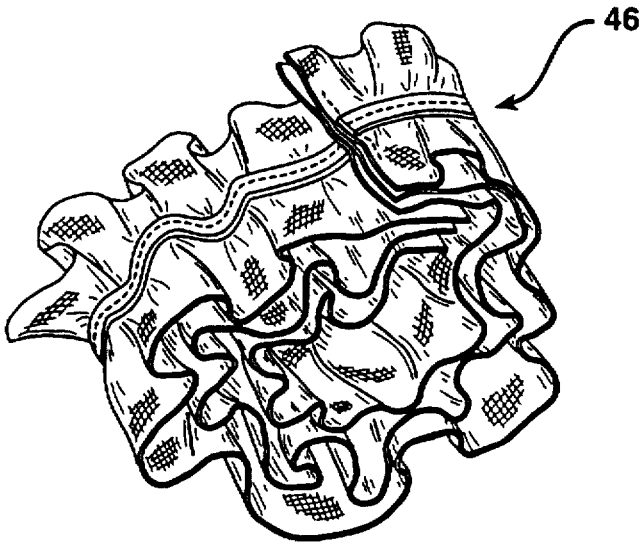
FIG. 13 illustrates the embodiment of FIG. 12 in assembled form.

FIG. 12 illustrates yet another embodiment of the present invention. As discussed above, an important aspect of the present invention is to provide a plurality of layers of fabric material which have edged or rim portions gathered independently so that when the assemblage including the elastic length is formed into a circle, the plurality of layers of gathered material bunch individually to provide a decorative fashion effect. FIG. 12 illustrates a manner of construction which can save on fabric material, and the embodiment illustrated in FIG. 12 includes three layers of fabric material. As illustrated, the first two layers 40 and 42 are comparable to the layers of fabric material 12 and 14 of the embodiment of FIG. 1. Additionally, however, a third layer of fabric material 43 is provided. The third layer of fabric material 43, however, extends from the elastic length 44 to a free edge or rim portion 45 which is essentially coextensive with the edge or rim portions of layers 40 and 42. In this way, there will be three layers of fabric on one side of the elastic layer 44, and only two layers of fabric on the other side. This arrangement of having differing layers of fabric material on respective sides of the elastic layer 44 can be varied in several ways and does not require three layers on one side of the elastic layer and two layers on the other; but could include two layers on one side of the elastic layer and one layer on the other side or any other combinations that are attractive. As illustrated in FIG. 13, the assemblage of FIG. 12 is formed into a circle with the ends stitched together to again form the decorative fashion accessory 46 having the same approximate look as other embodiments of the invention.

Figure 14:
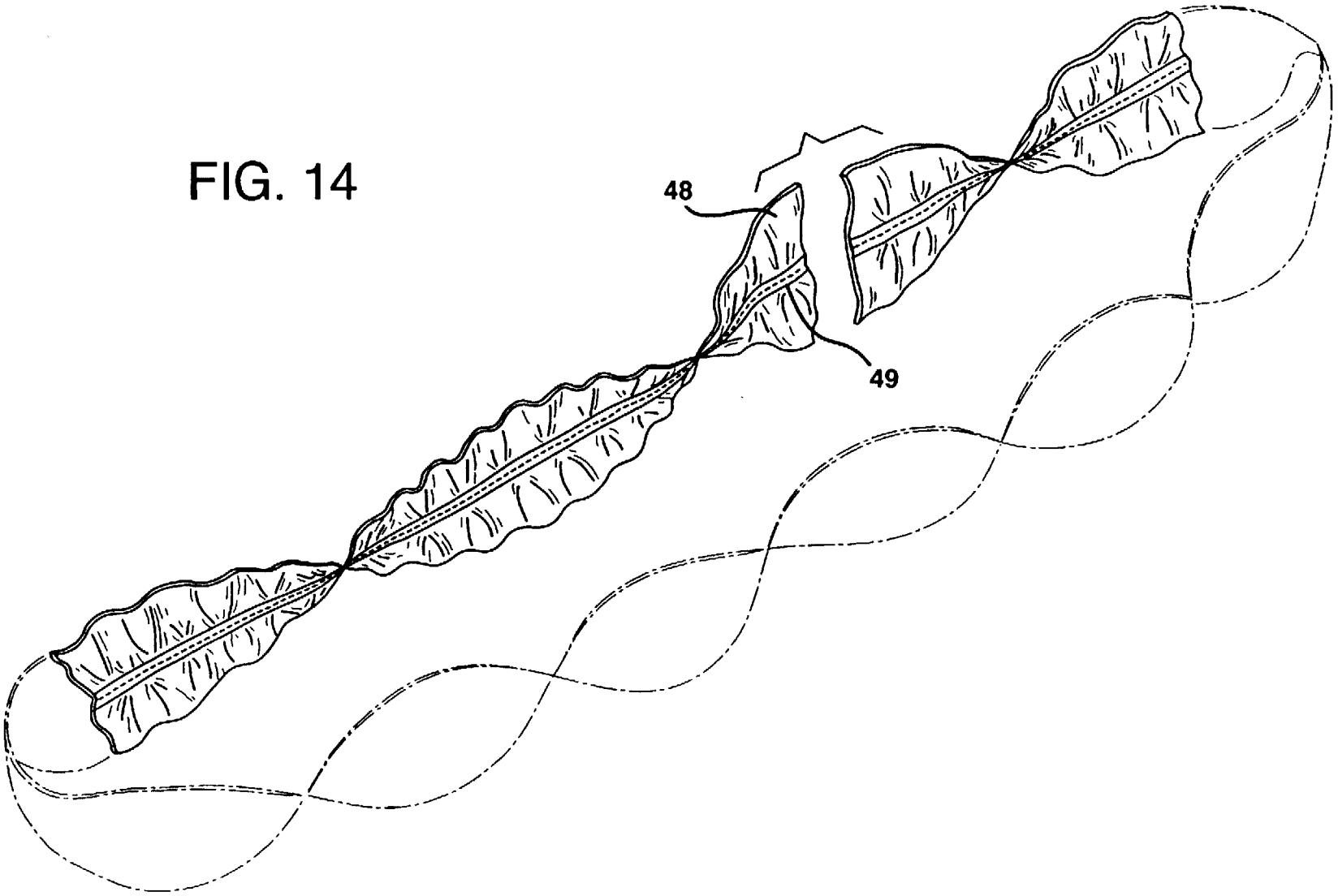
FIG. 14 illustrates yet another embodiment of the present invention.

In FIG. 14, length 48 of fabric material is twisted to form a spiral effect; and preferably is twisted twice to perform a spiral extending over 720 degrees. The elastic element 49 can be at least partially stretched and then stitched along the spiral contour of the central longitudinal axis; and thereafter another length of gathered fabric material can also be stitched in a spiralling fashion to the elastic element 49. As in the embodiment of FIG. 1, the second layer to be stitched to the spiral assemblage would preferably not be gathered as much as the first layer 48; and the spiralled assemblage of multiple layers of gathered material can then be formed into a circle and the ends stitched together to again form a decorative fashion accessory having multiple fabric layers which are individually bunched.

As will be understood by those skilled in the art, a decorative fashion accessory can be manufactured by several different techniques to produce various embodiments of the present invention. The present invention essentially consists of multiple layers of fabric material which have been gathered and then held to elastic length which preferably is at least partially stretched so that as the elastic length contracts it will cause the various layers of fabric material to be bunched individually. The resulting effect is a rather attractive decorative fashion accessory with multiple layers of fabric having rim or edged portions independently gathered and bunched so as to simulate a decorative flower. The present invention has been described in connection with preferred embodiments, but the scope of the invention is not intended to be limited of any details which are described above, but by the scope of the appended claims and the equivalents thereof.

What is claimed is:

1. A method of forming a decorative fashion accessory having tightly bunched layers of fabric formed of an elastic band and a plurality of layers of tightly bunched fabric, including the steps of stretching said elastic band, gathering said layers of fabric material appreciably in a direction transverse of the axis of the stretched portion of said elastic band to provide bunched fabric along said stretched portion of said band, securing said appreciably bunched fabric to said stretch elastic band, allowing said elastic band to contract to form tightly bunched layers of fabric material; and securing said elastic band into a circular configuration.

2. A method of making the decorative fashion assessory of claim 1, including the step of gathering at least one of said fabric layers appreciably more than the other fabric layer prior to stitching to said band.

3. A decorative fashion accessory having tightly bunched layers of fabric formed by the method of stretching an elastic band, gathering said layers of fabric material appreciably in a direction transverse of the axis of the stretched portion of said elastic band to provide bunched fabric along said stretched portion of such band, securing said appreciably bunched fabric to said stretched elastic band, allowing said elastic band to contract to form tightly bunched layers of fabric material; and securing said elastic band into a circular configuration.

4. The decorative fashion accessory as set forth in claim 3, further including the step of gathering at least one of said fabric layers appreciably more than the other fabric layer prior to stitching to said band.

5. A decorative fashion accessory having an elastic band, and a plurality of layers of fabric material held in a gathered arrangement along a stretched portion of said band, said layers each being held by said band to provide respective rim portions bunching as said elastic band contracts to its rest condition, said layers having been formed from a continuous strip of fabric material having been gathered and stitched along an elastic length that has been then coiled to form said band as said elastic length is stretched, said strip being stitched to maintain a coiled configuration.

6. A decorative fashion accessory having an elastic band, a plurality of layers of fabric material held in a gathered arrangement along a stretched portion of said band, said layers each being held by said band to provide respective rim portions bunching as said elastic band contracts to its rest condition, said layers being formed of a continuous gathered strip of fabric material having been twisted axially to form a spiral.

7. A decorative fashion accessory having an elastic band, a plurality of layers of fabric material held in a gathered arrangement along a stretched portion of said band, said layers each being held by said band to provide respective rim portions bunching as said elastic band contracts to its rest condition, said layers being gathered appreciably along the stretched portion of said bands so that tightly bunched layers of fabric will be formed as said elastic band contracts to its rest condition, said layers having been formed from a continuous strip of fabric material having been gathered and stitched along an elastic length that has been then coiled as said elastic length is stretched, said strip being stitched to maintain the coiled configuration.

* * * * *